US008019086B2

(12) United States Patent
Tsutsui et al.

(10) Patent No.: US 8,019,086 B2
(45) Date of Patent: Sep. 13, 2011

(54) STEREO SYNTHESIZER USING COMB FILTERS AND INTRA-AURAL DIFFERENCES

(75) Inventors: Ryo Tsutsui, Ibaraki (JP); Yoshihide Iwata, Ibaraki (JP); Steven D. Trautmann, Ibaraki (JP)

(73) Assignee: Texas Instruments Incorporated, Dallas, TX (US)

( * ) Notice: Subject to any disclaimer, the term of this patent is extended or adjusted under 35 U.S.C. 154(b) by 1271 days.

(21) Appl. No.: 11/560,390

(22) Filed: Nov. 16, 2006

(65) Prior Publication Data

US 2008/0118072 A1 May 22, 2008

(51) Int. Cl.
*H04R 5/00* (2006.01)

(52) U.S. Cl. ..... 381/17

(58) Field of Classification Search ..... 381/17, 381/1, 18, 310

See application file for complete search history.

(56) References Cited

U.S. PATENT DOCUMENTS 6,005,946 A 12/1999 Varga et al.
6,175,631 B1 1/2001 Davis et al.
2005/0163331 A1 7/2005 Gao et al.
2006/0029231 A1* 2/2006 Henn et al. ..... 381/1
2006/0120533 A1 6/2006 Chen

* cited by examiner

*Primary Examiner* — Curtis Kuntz

*Assistant Examiner* — Hai Phan

(74) *Attorney, Agent, or Firm* — Robert D. Marshall, Jr.; W. James Brady; Frederick J. Telecky, Jr.

(57) ABSTRACT

A method for creating a stereophonic sound image out of a monaural signal combines two sub-methods. Comb filters decorrelate the left and right channel signals. Intra-aural difference cues, such as an Intra-Aural Time Difference (ITD) and an Intra-aural Intensity Difference (IID) separated channels. Strict complementary (SC) linear phase FIR filters divide the incoming monaural signal into three frequency band separation. The comb filters and ITD/IID applied to the low and high frequency bands create a simulated stereo sound image for the instruments other than human voice. Listening tests indicate that this invention provides a wider stereo sound image than previous methods, while retaining human voice centralization. Since the comb filter solution and ITD/IID solution can share the same filter bank, the computational cost of this method is almost the same as the previous method.

17 Claims, 3 Drawing Sheets

STEREO SYNTHESIZER USING COMB FILTERS AND INTRA-AURAL DIFFERENCES

TECHNICAL FIELD OF THE INVENTION

The technical field of this invention is stereophonic audio synthesis applied to enhancing the presentation of both music and voice for more pleasant sound quality.

BACKGROUND OF THE INVENTION

Currently, most commercial audio equipment has stereophonic (stereo) sound playback capability. Stereo sound provides a more natural and pleasant quality than monaural (mono) sound. Nevertheless there are still some situations which employ mono sound signals including telephone conversations, TV programs, old recordings, radios, and so forth. Stereo synthesis creates artificial stereo sounds from plain mono sounds attempting to reproduce a more natural and pleasant quality.

The present inventors have previously described two distinctively different synthesis algorithms. The first of these U.S. patent application Ser. No. 11/560,397 entitled BAND-SELECTABLE STEREO SYNTHESIZER USING COMPLEMENTARY FILTER PAIR applies comb filters [referred to in the disclosure as complementary linear phase FIR filters] to a selected range of frequencies. Comb filters are commonly used in signal processing. The basic comb filter includes a network producing a delayed version of the incoming signal and a summing function that combines the undelayed version with the delayed version causing phase cancellations in the output and a spectrum that resembles a comb. Stated another way, the composite output spectrum has notches in amplitude at selected frequencies. When arranging separate comb filters to produce allocated notches of at different frequencies for left and right channels, the outputs from the both channels become uncorrelated. This causes the band-selected sound image to be ambiguous and thus wider. Typically, the purpose of band selection is to centralize just the human voices. The second earlier invention U.S. patent application Ser. No. 11/560,397 entitled LOW COMPUTATION MONO TO STEREO CONVERSION USING INTRA-AURAL DIFFERENCES describes the use of an Intra-Aural Time Difference (ITD) and an Intra-Aural Intensity Difference (IID). This simulates the cultural fact that, in many live orchestras and some rock bands, the low instruments tend to be located toward the right and the high instruments on the left. To do this, the incoming mono signal is split into three frequency bands and then sent to left and right channels with different delays and gains for each channel, so that the band signals add up to the original, but with ITD and IID in low and high bands respectively.

FIG. 1 illustrates a functional block diagram of a stereo synthesis circuit using intra-aural time difference (ITD) and an intra-aural intensity difference (IID). The input monaural sound 100 is split into three frequency ranges using high pass filter 101, mid-band pass filter 102 and low pass filter 103. Mid-band frequencies 119 are passed through sample delayA 104 and sample delayD 107. High pass frequencies 121 are passed to sample delayB 105 and low pass frequencies 124 are passed to sample delayC 106. The output of sample delayB 105 supplies the input of high band attenuation 108 which forms signal 123. The output of sample delayC 106 supplies the input of low band 109 which forms signal 126. The resulting six signal components 121 through 126 are routed to two summing networks 110 and 111. Summing network 110 combines high pass output 121, mid-band delayed output 122 and low pass delayed and attenuated output 126. The resulting left channel signal 116 is amplified by left amplifier 112 and passes to left output driver 114. In similar fashion, summing network 111 combines low pass output 124, mid-band delayed output 125 and high pass delayed and attenuated output 123. The resulting right channel signal 117 is amplified by right amplifier 113 and passes to right output driver 115.

SUMMARY OF THE INVENTION

This invention is a new method for creating a stereophonic sound image out of a monaural signal. The method combines two synthesis techniques. In the first technique comb filters de-correlate the left and right channel signals. The second technique applies intra-aural difference cues. Specifically this invention applies intra-aural time difference (ITD) and intra-aural intensity difference (IID) cues. The present invention performs a three-frequency band separation on the incoming monaural signal using strictly complementary (SC) linear phase FIR filters. Comb filters and ITD/IID are applied to the low and high frequency bands to create a simulated stereo sound image for instruments other than human voice. Listening tests indicate that the method of this invention provides a wider stereo sound image than previous methods, while retaining human voice centralization. Since the comb filter computation and ITD/IID computation can share the same filter bank, the invention does not increase the computational cost compared to the previous method.

BRIEF DESCRIPTION OF THE DRAWINGS

These and other aspects of this invention are illustrated in the drawings, in which.

DETAILED DESCRIPTION OF PREFERRED EMBODIMENTS

The stereo synthesizer of this invention combines the best features of two techniques employed in prior art. Comb filters provide wider sound image and the combination of ITD/IID gives sound quality more faithfully reproducing the character of the original mono signal. This application describes a composite method that combines the two algorithms creating a wider sound image than the two methods provide individually. Since the two algorithms can share the same filter bank, which is three strictly complementary (SC) linear phase FIR filters, the integrated system can maintain a simple structure and the computational cost does not unduly increase.

Figure 1:
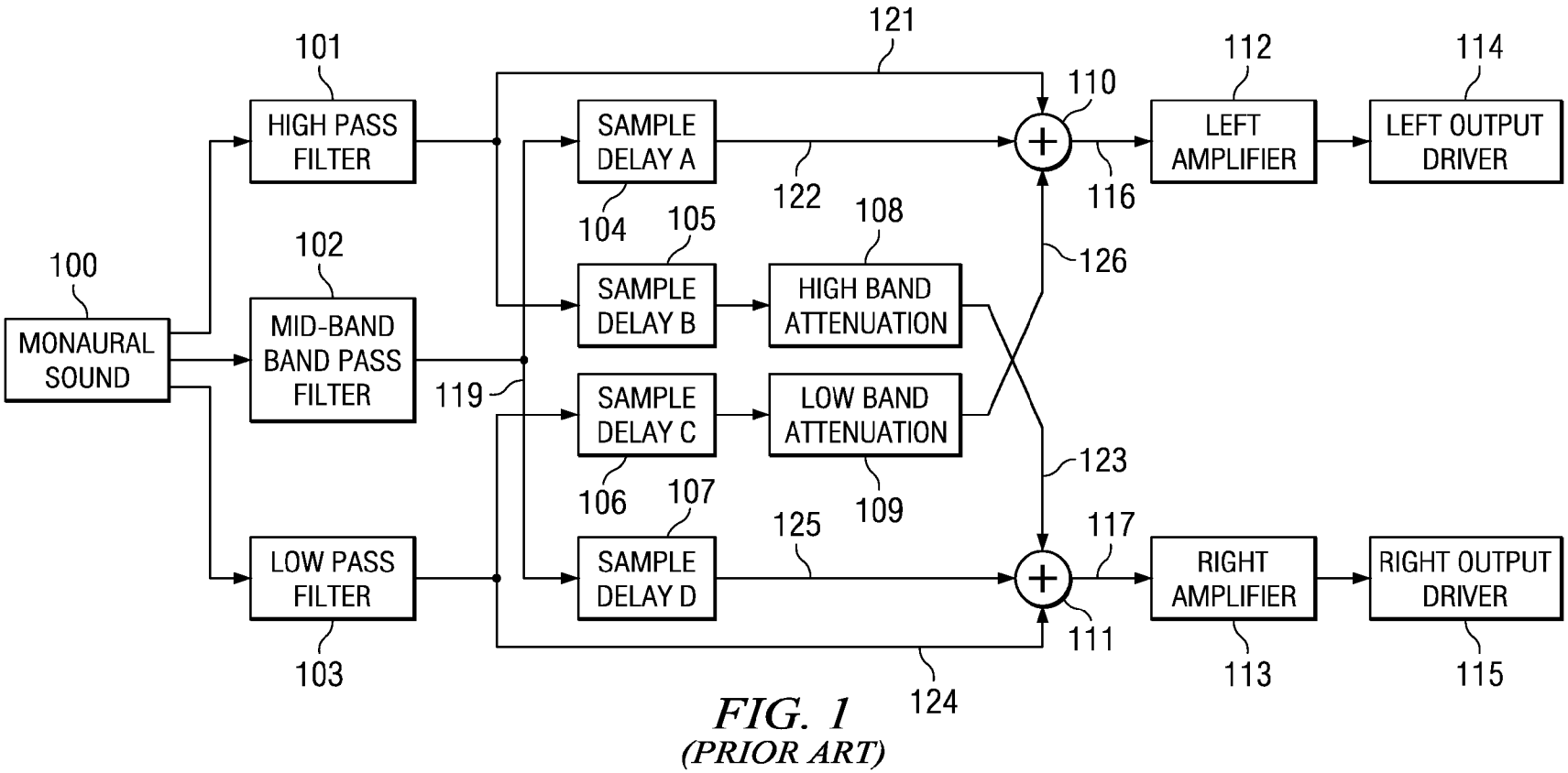
FIG. 1 (PRIOR ART)
FIG. 1 illustrates the basic principles of ITD and IID implemented in functional block diagram form (Prior Art)
Figure 2:
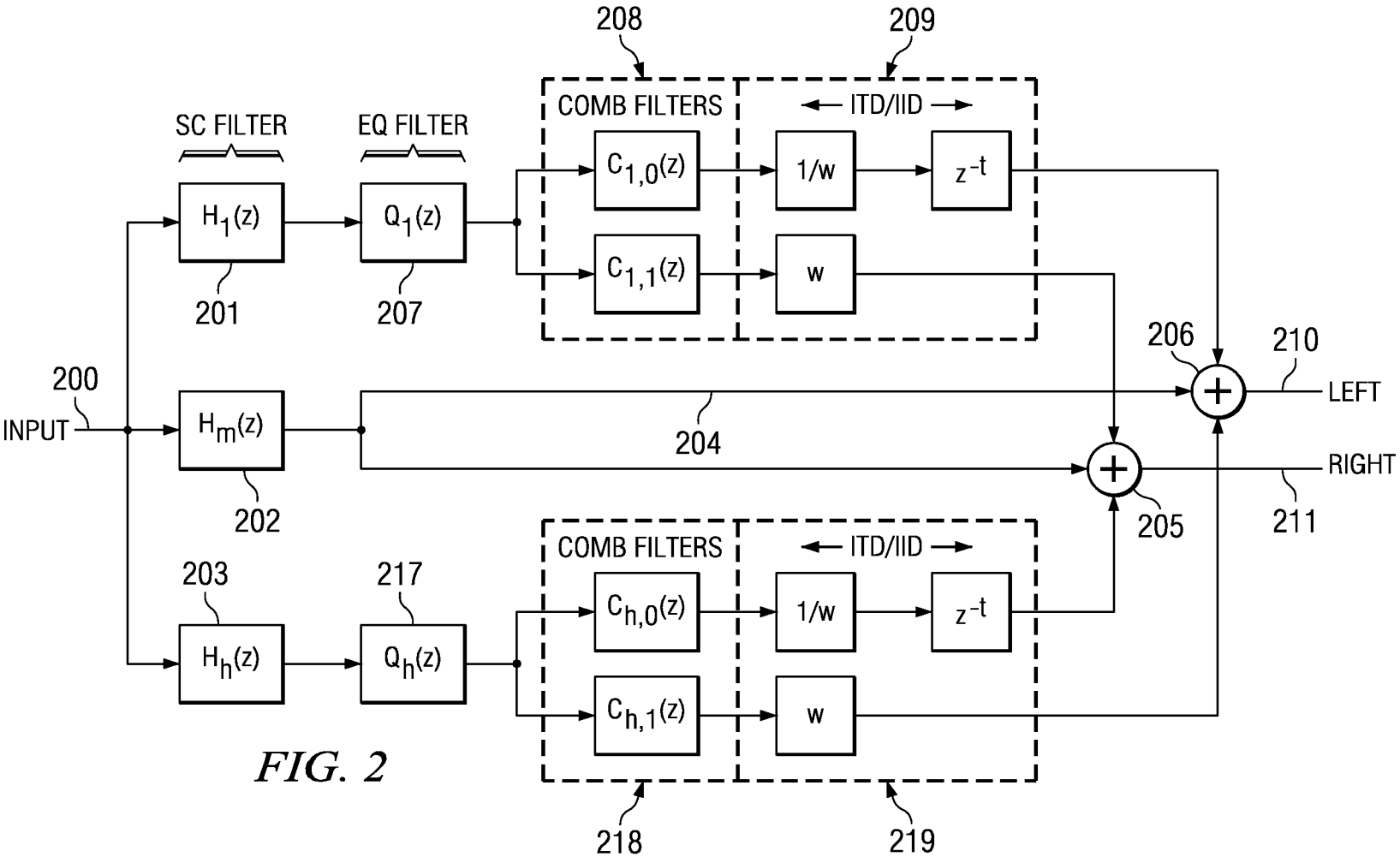
FIG. 2 illustrates the block diagram of the stereo synthesizer of this invention.

FIG. 2 illustrates the block diagram of the stereo synthesizer of this invention. First, the incoming monaural signal 200 is separated into three regions using three SC FIR filters: (a) a low pass filter (LPF) $H_l(z)$ 201; a band pass filter (BPF) $H_m(z)$ 202; and a high pass filter (HPF) $H_h(z)$ 203. The outputs from $H_l(z)$ and $H_h(z)$ are processed with the respective comb filters 208 and 218 to create left channel 210 and right channel 211 signals with a simulated stereo sound image. The comb filter outputs for each channel are mixed with gains and delays in respective ITD/IID blocks 209 and 219, in order to generate ITD and IID. The output 204 from $H_m(z)$ 202 is added to these simulated stereo signals in summing networks 205 and 206, so that the total output signal sums up to the original, but with frequency-band-partly widened sound. Respective optional equalization (EQ) filters 207 and 217 compensate for the frequencies that might be distorted by the notches of the comb filters 208 and 218. In practice, the low band EQ filter $Q_l(z)$ 207 and high band EQ filter $Q_h(z)$ 217 are designed as respective low and high shelving filters.

In FIG. 2, $H_l(z)$ 201, $H_m(z)$ 202, and $H_h(z)$ 203 are said to be strictly complementary to each other only if:

$$H_l(z)+H_m(z)+H_h(z)=cZ^{-N_0} \tag{1}$$

is satisfied, where c=1, in particular. Thus just adding all these filter outputs perfectly reconstructs the original signal. It is also important to make these FIR filters be phase linear with an even number order N. With the choice $N_0=N/2$, equation (1) can be written as:

$$H_l(z)+H_m(z)+H_h(z)=z^{-N/2} \tag{2}$$

Substituting $z=e^{j\omega}$ and recognizing that $H_l(e^{j\omega})$, $H_m(e^{j\omega})$ and $H_h(e^{j\omega})$ are linear phase whose phase terms are given as $e^{-j\omega N/2}$, we have the frequency response relationship among the three filters as:

$$|H_l(e^{-j\omega})|+|H_m(e^{-j\omega})|+|H_h(e^{-j\omega})|=1 \tag{3}$$

Let $H_l(z)$ be the low pass filter (LPF) and $H_h(z)$ be the high pass filter (HPF). Then $H_m(z)$ will be a band-pass filter (BPF0). The output from low pass filter ($H_l(z)$) 201 is calculated as:

$$y_1(n) = \sum_{i=0}^{N} h_1(i)x(n-i) \tag{4A}$$

and the output from high pass filter ($H_h(z)$) 203 is calculated as:

$$y_h(n) = \sum_{i=0}^{N} h_h(i)x(n-i) \tag{4B}$$

with $h_l(n)$ and $h_h(n)$ designating the respective impulse responses. Then the other output can be calculated just from:

$$y_m(n)=x(n-N/2)-y_l(n)-y_h(n) \tag{5}$$

Both equation (3) and equation (5) illustrate the benefit of using the SC linear phase FIR filters. Implementing a low pass filter and a high pass filter and just subtracting their outputs from the input signal gives a band pass filter output. This means that the major computational cost is for calculating only two filter outputs out of the three.

Figure 3:
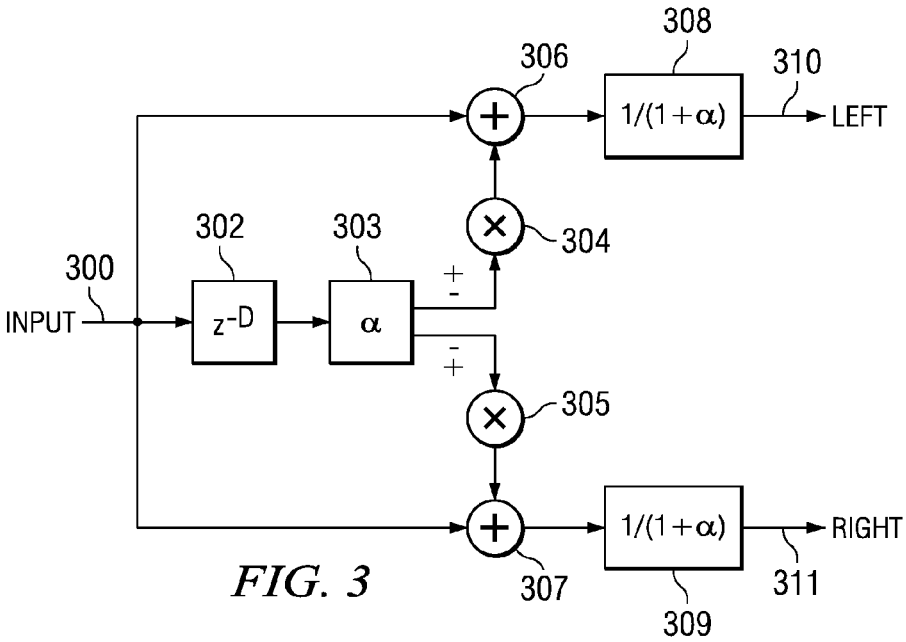
FIG. 3 illustrates the block diagram of each of comb filter pairs used in the stereo synthesizer of this invention.
Figure 4:
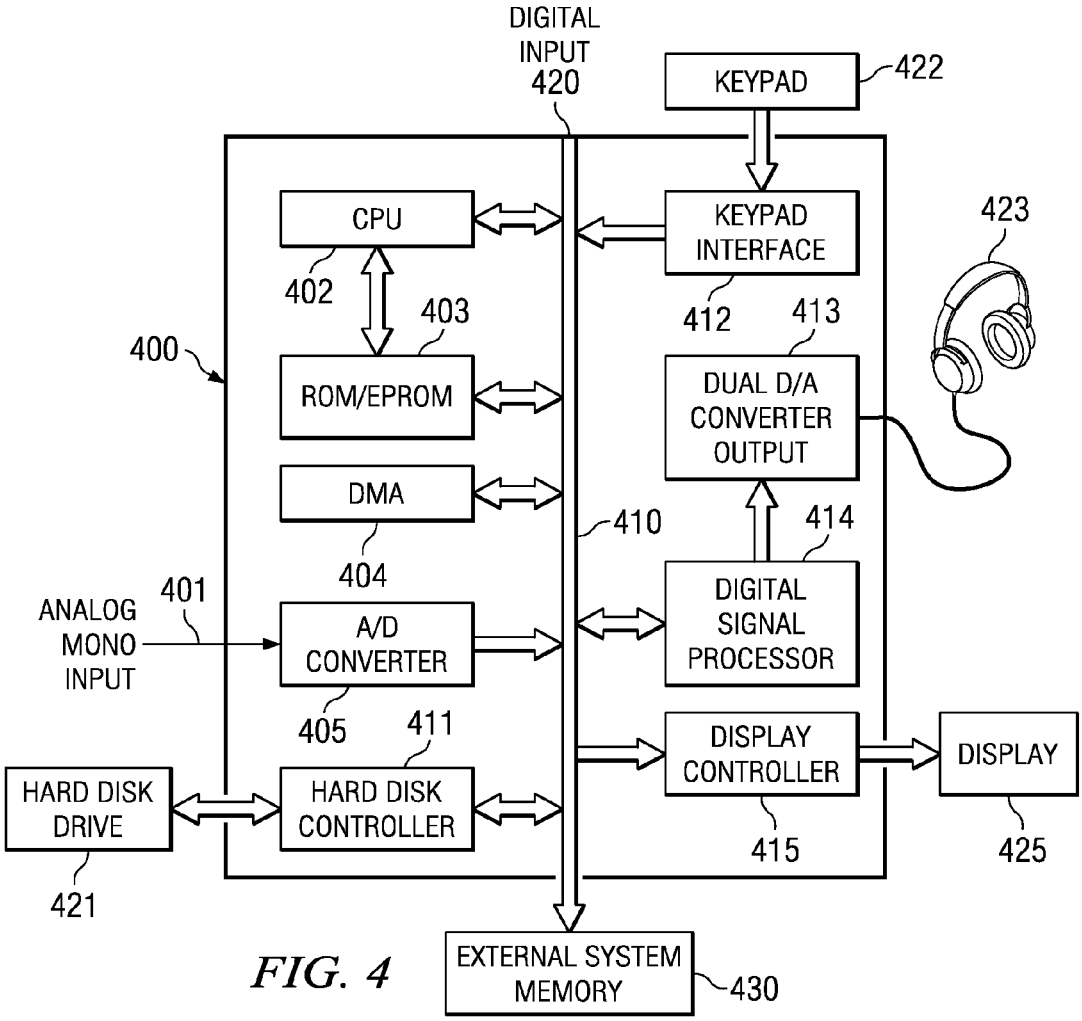
FIG. 4 illustrates a portable music system such as might use this invention.

FIG. 3 illustrates the block diagram of each comb filter pair 208 and 218 used for stereo synthesis. Two comb filters are employed in each of the left and right output channels. Let $C_0(z)$ and $C_1(z)$ denote the respective transfer functions for the left and right channels, then:

$$\begin{cases} C_0(z) = (1 \pm \alpha z^{-D})/(1+\alpha) \\ C_1(z) = (1 \mp \alpha z^{-D})/(1+\alpha) \end{cases} \tag{6}$$

where: D is a delay that controls the stride of the notches of the comb; and $\alpha$ controls the depth of the notches. Typically $0<\alpha\leqq 1$. The magnitude responses are given by:

$$\left.\begin{aligned} |C_0(e^{-j\omega})| &= \sqrt{1-\frac{4\alpha}{(1+\alpha^2)}\sin^2\frac{\omega D}{2}} \\ |C_1(e^{-j\omega})| &= \sqrt{1-\frac{4\alpha}{(1+\alpha^2)}\cos^2\frac{\omega D}{2}} \end{aligned}\right\} \tag{7A}$$

or $$\left.\begin{aligned} |C_0(e^{-j\omega})| &= \sqrt{1-\frac{4\alpha}{(1+\alpha^2)}\cos^2\frac{\omega D}{2}} \\ |C_1(e^{-j\omega})| &= \sqrt{1-\frac{4\alpha}{(1+\alpha^2)}\sin^2\frac{\omega D}{2}} \end{aligned}\right\} \tag{7B}$$

The applicable magnitude response depends on the signs of the multiplier that are applied to the delayed-weighted path. Equations (7A) and (7B) show that both filters have peaks and notches with a constant stride of $2\pi/D$. The peaks of one filter are placed at the notches of the other filter and vice-versa. This de-correlates the output channels resulting in the sound image becoming ambiguous and thus wider.

In a spatial hearing, a sound coming from left side of a listener arrives at the right ear of the listener later than the left ear. The left side sound is more attenuated at the right ear than at the left ear. The intra-aural time difference (ITD) and intra-aural intensity difference (IID) provide sound localization cues that make use of these spatial hearing mechanisms.

Referring back to FIG. 2, different weights and delays are applied to the left and right channels of the comb filter output. For w>1 and $\tau>0$, the listener will perceive the high pass filtered sound is coming from left side, because the right channel signal is attenuated and delayed. Similarly, the low pass filtered sound will seem to come from right side. This arrangement simulates many live orchestras and some rock bands, in which the low instruments tend to be located toward the right and the high instruments on the left. This produces wider sound image for the entire stereo output than by just employing the comb filters.

The following is a description of a design example. In this example, a sampling frequency was chosen 44.1 kHz. The SC FIR filters were designed using MATLAB. This example uses order 32 FIR $H_l(z)$ and $H_h(z)$ selected based on the least square error prototype. The cut off frequency of the low pass filter $H_l(z)$ was chosen as 300 Hz and the cut off frequency of the high pass filter $H_h(z)$ was chosen as 3 kHz. These selections puts the lower formant frequencies of the human voice in their stop bands. The band pass filter $H_m(z)$ was calculated using equation (5). This was confirmed as providing a band pass filter magnitude response. The low and high pass filters were implemented using equation (4).

The comb filters were designed as follows. Comb filters 208 $C_{l,0}$ and $C_{l,1}$ for the low channel:

$$\left.\begin{aligned} C_{1,0} &= (1+0.7z^{D})/(1+0.7) \\ C_{1,1} &= (1-0.7z^{D})/(1+0.7) \end{aligned}\right\} \tag{8A}$$

Comb filters 218 $C_{h,0}$ and $Ch_{,1}$ for the low channel:

$$\left.\begin{aligned} C_{h,0} &= (1-0.7z^D)/(1+0.7) \\ C_{h,1} &= (1+0.7z^D)/(1+0.7) \end{aligned}\right\} \quad (8B)$$

where: D=8 milliseconds corresponding to 352 filter taps was selected for the all comb filters. The purpose of flipping the signs of the multiplier for low band and high band was to cancel the notches of each other in the transition region of LPF and HPF. This contributed to further centralizing the human voice, while the sound image for the other instruments was unaffected. In this example only intra-aural-intensity differences (IID) were implemented. The intensity difference w was 1.4.

Brief listening confirmed that this method provides wider sound image than the two previous methods, while the voice band signals were centralized the same as with those methods.

Referring back to FIG. 2, the SC FIR filters produce most of the computational load. This is because the comb filters can be considered as order 1 FIR implementations and IID/ITD can be considered as order 0 FIR implementations, The low pass filter and the high pass filter require much longer taps to obtain a desired frequency band separation. The EQ filters, if present, can be designed with first order infinite impulse response (IIR) filters, which is of lower computational cost. Thus a make computation comparison between the present method and previous methods can be made by just considering the SC FIR filters that implement exactly the same filter bank structure. The computational cost does not differ appreciably. The prior methods employ two band separation using a band-pass and a band stop filter, where only one of the two must be actually be implemented because of the SC linear phase FIR property. This means that the method of the present invention is one-filter-heavier than the earlier approach. However, low-pass filters (LPF) and high pass filters (HPF) can be designed with shorter filter taps than band-pass filters (BPF). Indeed order 32 finite impulse response (FIR) filters were used for low pass and high pass filters in the research leading to this invention. These FIRs employ about one-half the taps used in prior methods for the band pass filter (BPF). As a result the computational cost for this invention is essentially the same as previous methods.

This invention is a stereo synthesis method that combines two previous methods, the comb filter method and intra-aural difference method. Through listening tests it has been confirmed that this method provides a wider stereo sound image than previous methods, while the human voice centralization property is retained. The computational cost of the present invention is almost the same as the previous methods.

What is claimed is:

1. A method of synthesizing stereo sound from a monaural sound signal comprising the steps of:

low pass filtering the monaural sound signal;

producing first and second decorrelated low pass filtered signals;

producing respective first and second low pass intra-aural difference signals from said first and second decorrelated low pass filtered signals;

band pass filtering the monaural sound signal;

high pass filtering the monaural sound signal;

producing first and second decorrelated high pass filtered signals;

said steps of producing first and second decorrelated low pass filtered signals and producing first and second decorrelated high pass filtered signals each include filtering an input with respective first and second complementary comb filters, wherein frequency peaks of said first comb filter matches frequency notches of said second comb filter and frequency notches of said first comb filter matches frequency peaks of said second comb filter, where said first comb filter $C_0$ is calculated by:

$$C_0=(1+\alpha z^D)/(1+\alpha)$$

said second comb filter $C_1$ is calculated by:

$$C_1=(1-\alpha z^D)/(1+\alpha)$$

where: $C_0$ is the first comb filter output; $C_1$ is the second comb filter output; D is a delay factor; $\alpha$ is a scaling factor; and z is the input signal;

producing respective first and second high pass intra-aural difference signals from said first and second decorrelated high pass filtered signals;

summing said first low pass intra-aural difference signal, said band pass signal and said second high pass intra-aural difference signal to produce a first stereo output signal; and summing said second low pass intra-aural difference signal, said band pass signal and said first high pass intra-aural difference signal to produce a second stereo output signal.

2. The method of claim 1, wherein;

the delay D is 8 mS; and the scaling factor $\alpha$ is within the range $0<\alpha\leqq 1$.

3. The method of claim 1, wherein:

said steps of producing first and second intra-aural difference low pass filtered signals and producing first and second intra-aural difference high pass filtered signals each include providing a differential gain on said first and second decorrelated signals.

4. The method of claim 1, wherein:

said step of producing first and second intra-aural difference low pass filtered signals comprises amplifying said first decorrelated low pass signal with a first gain to produce said first intra-aural difference low pass filtered signal and amplifying said second intra-aural difference low pass filtered signal with a second gain lower than said first gain;

said step of producing first and second intra-aural difference high pass filtered signals comprises amplifying said first decorrelated high pass signal with said second gain to produce said first intra-aural difference high pass filtered signal and amplifying said second intra-aural difference high pass filtered signal with said first gain;

said step of summing to produce said first stereo output signal produces a left stereo signal; and said step of summing to produce said second stereo output signal produces a right stereo signal.

5. The method of claim 1, wherein:

said steps of producing first and second intra-aural difference low pass filtered signals and producing first and second intra-aural difference high pass filtered signals each include delaying one of said decorrelated signals.

6. The method of claim 1, wherein:

said step of producing first and second intra-aural difference low pass filtered signals comprises delaying said second decorrelated low pass filtered signal;

said step of producing first and second intra-aural difference high pass filtered signals comprises delaying said first decorrelated high pass signal;

said step of summing to produce said first stereo output signal produces a left stereo signal; and said step of summing to produce said second stereo output signal produces a right stereo signal.

7. A method of synthesizing stereo sound from a monaural sound signal comprising the steps of:

low pass filtering the monaural sound signal;

producing first and second decorrelated low pass filtered signals;

said step of producing said first decorrelated low pass filter signal $C_{l,0}$ is calculated by:

$$C_{l,0}=(1+\alpha z^{D})/(1+\alpha)$$

said step of producing said second decorrelated low pass filter signal $C_{l,1}$ is calculated by:

$$C_{l,1}=(1-\alpha z^{D})/(1+\alpha)$$

producing respective first and second low pass intra-aural difference signals from said first and second decorrelated low pass filtered signals;

band pass filtering the monaural sound signal;

high pass filtering the monaural sound signal;

producing first and second decorrelated high pass filtered signals;

said step of producing said first decorrelated high pass filter signal $C_{h,0}$ is calculated by:

$$C_{h,0}=(1-\alpha z^{D})/(1+\alpha);$$

said step of producing said second decorrelated high pass filter signal $C_{h,1}$ is calculated by:

$$C_{h,1}=(1+0.7z^{D})/(1+0.7)$$

where: $C_{l,0}$ is the first decorrelated low pass filter output; $C_{l,1}$ is the second decorrelated low pass filter output; $C_{h,0}$ is the first decorrelated high pass filter output; $C_{h,1}$ is the second decorrelated high pass filter output; D is a delay factor; $\alpha$ is a scaling factor; and z is the input signal;

producing respective first and second high pass intra-aural difference signals from said first and second decorrelated high pass filtered signals;

summing said first low pass intra-aural difference signal, said band pass signal and said second high pass intra-aural difference signal to produce a first stereo output signal; and summing said second low pass intra-aural difference signal, said band pass signal and said first high pass intra-aural difference signal to produce a second stereo output signal.

8. The method of claim 7, wherein;

the delay D is 8 mS; and the scaling factor $\alpha$ is within the range $0<\alpha\leqq 1$.

9. The method of claim 7, wherein:

said steps of producing first and second intra-aural difference low pass filtered signals and producing first and second intra-aural difference high pass filtered signals each include providing a differential gain on said first and second decorrelated signals.

10. The method of claim 7, wherein:

said step of producing first and second intra-aural difference low pass filtered signals comprises amplifying said first decorrelated low pass signal with a first gain to produce said first intra-aural difference low pass filtered signal and amplifying said second intra-aural difference low pass filtered signal with a second gain lower than said first gain;

said step of producing first and second intra-aural difference high pass filtered signals comprises amplifying said first decorrelated high pass signal with said second gain to produce said first intra-aural difference high pass filtered signal and amplifying said second intra-aural difference high pass filtered signal with said first gain;

said step of summing to produce said first stereo output signal produces a left stereo signal; and said step of summing to produce said second stereo output signal produces a right stereo signal.

11. The method of claim 7, wherein:

said steps of producing first and second intra-aural difference low pass filtered signals and producing first and second intra-aural difference high pass filtered signals each include delaying one of said decorrelated signals.

12. The method of claim 7, wherein:

said step of producing first and second intra-aural difference low pass filtered signals comprises delaying said second decorrelated low pass filtered signal;

said step of producing first and second intra-aural difference high pass filtered signals comprises delaying said first decorrelated high pass signal;

said step of summing to produce said first stereo output signal produces a left stereo signal; and said step of summing to produce said second stereo output signal produces a right stereo signal.

13. A method of synthesizing stereo sound from a monaural sound signal comprising the steps of:

low pass filtering the monaural sound signal;

producing first and second decorrelated low pass filtered signals;

producing respective first and second low pass intra-aural difference signals from said first and second decorrelated low pass filtered signals;

band pass filtering the monaural sound signal;

high pass filtering the monaural sound signal;

said steps of low pass filtering the monaural sound signal, band pass filtering the monaural sound signal and high pass filtering the monaural sound signal comprises using strict complementary (SC) linear phase finite impulse response (FIR) filters;

said step of low pass filtering is calculated as:

$$y_1(n)=\sum_{i=0}^{N} h_1(i)x(n-i);$$

said step of high pass filtering is calculated as:

$$y_h(n)=\sum_{i=0}^{N} h_h(i)x(n-i);$$

said step of band pass filtering is calculated as:

$$y_m(n)=x(n-N/2)-y_1(n)-y_h(n);$$

where: $y_l(n)$ is the low pass filter output for sample n; $y_h(n)$ is the high pass filter output for sample n; N is a number of filter taps; $h_l(i)$ is the low pass filter impulse response; $h_h(i)$ is the low pass filter impulse response; x(n) is the input signal for sample n; n is the input sample number; and i is an index variable;

producing first and second decorrelated high pass filtered signals;

producing respective first and second high pass intra-aural difference signals from said first and second decorrelated high pass filtered signals;

summing said first low pass intra-aural difference signal, said band pass signal and said second high pass intra-aural difference signal to produce a first stereo output signal; and summing said second low pass intra-aural difference signal, said band pass signal and said first high pass intra-aural difference signal to produce a second stereo output signal.

14. The method of claim 13, wherein:

said steps of producing first and second intra-aural difference low pass filtered signals and producing first and second intra-aural difference high pass filtered signals each include providing a differential gain on said first and second decorrelated signals.

15. The method of claim 13, wherein:

said step of producing first and second intra-aural difference low pass filtered signals comprises amplifying said first decorrelated low pass signal with a first gain to produce said first intra-aural difference low pass filtered signal and amplifying said second intra-aural difference low pass filtered signal with a second gain lower than said first gain;

said step of producing first and second intra-aural difference high pass filtered signals comprises amplifying said first decorrelated high pass signal with said second gain to produce said first intra-aural difference high pass filtered signal and amplifying said second intra-aural difference high pass filtered signal with said first gain;

said step of summing to produce said first stereo output signal produces a left stereo signal; and said step of summing to produce said second stereo output signal produces a right stereo signal.

16. The method of claim 13, wherein:

said steps of producing first and second intra-aural difference low pass filtered signals and producing first and second intra-aural difference high pass filtered signals each include delaying one of said decorrelated signals.

17. The method of claim 13, wherein:

said step of producing first and second intra-aural difference low pass filtered signals comprises delaying said second decorrelated low pass filtered signal;

said step of producing first and second intra-aural difference high pass filtered signals comprises delaying said first decorrelated high pass signal;

said step of summing to produce said first stereo output signal produces a left stereo signal; and said step of summing to produce said second stereo output signal produces a right stereo signal.

* * * * *